US008169314B2

(12) United States Patent
Cantolino

(10) Patent No.: US 8,169,314 B2
(45) Date of Patent: May 1, 2012

(54) WATER SENSOR SWITCH SYSTEM

(76) Inventor: Christopher R. Cantolino, Brandenton, FL (US)

( * ) Notice: Subject to any disclaimer, the term of this patent is extended or adjusted under 35 U.S.C. 154(b) by 239 days.

(21) Appl. No.: 12/201,453

(22) Filed: Aug. 29, 2008

(65) Prior Publication Data

US 2010/0052921 A1 Mar. 4, 2010

(51) Int. Cl.
*G08B 29/00* (2006.01)
*G08B 21/00* (2006.01)

(52) U.S. Cl. ..... 340/506; 340/620

(58) Field of Classification Search ..... 340/620
See application file for complete search history.

(56) References Cited

U.S. PATENT DOCUMENTS 4,736,622 A * 4/1988 Miller et al. ..... 73/49.2
4,736,623 A * 4/1988 Brown et al. ..... 73/49.2
5,404,048 A * 4/1995 Panner ..... 307/118
5,428,347 A * 6/1995 Barron ..... 340/604
6,041,611 A * 3/2000 Palmer ..... 62/286
2007/0235097 A1 * 10/2007 Detwiler ..... 137/899.2
* cited by examiner

*Primary Examiner* — Benjamin C Lee
*Assistant Examiner* — Cal Eustaquio
(74) *Attorney, Agent, or Firm* — Arthur W. Fisher, III

(57) ABSTRACT

A drain pan system for activating a pump when detecting a predetermined water level in a drain pan is provided. The drain pan system includes the drain pan, the pump, a water sensor, first and second inputs, a control section and a switching device. The water sensor is coupled to the drain pan for detecting a level of water in the drain pan, the water sensor generating a drain pan water level detection signal in response to detection of the level of the water in the drain pan equal to or greater than a predetermined water level. The pump is coupled to the drain pan and, when activated, pumps the water from the drain pan. The first input couples a source line to a first power potential. The second input couples a neutral line to a second power potential, the second power potential being a neutral potential. The control section is coupled to the water sensor for receiving the drain pan water level detection signal therefrom. The control section is also connected to the first and second inputs and generates a switching signal in response to the drain pan water level detection signal. In addition, the switching device is coupled to the control section for connecting the first input to the pump in response to the switching signal, thereby activating the pump to pump the water from the drain pan.

10 Claims, 6 Drawing Sheets

WATER SENSOR SWITCH SYSTEM

FIELD OF THE INVENTION

The present invention generally relates to drain pan water systems for air handling systems, and more particularly relates to a water sensor switch for a drain pan water system.

BACKGROUND OF THE DISCLOSURE

Air handling systems such as furnaces or other heating, ventilating or air conditioning systems typically have a drain pan underneath at least portions of the air handling mechanism to catch collected condensation. With air conditioners, the condensation produced in a twenty-four hour period can be more than the drain pan can hold. Therefore, the drain pan can be mounted at a slant and connected to a pipe or hose to carry the condensated water to a drain connected to a structure's sewage system or to a location outside the structure.

Sometimes, the removal of the condensated water requires pumping the water out of the drain pan. Conventionally, a drain pan system includes a sensor, called a water sensor, that is placed in the drain pan and measures the level of the water therein. When the water level reaches a predetermined height, the water sensor generates a signal and sends it to a water sensor switching circuit to activate the pump. When enough water is removed from the drain pan for the water sensor to stop sending the signal, the water sensor switch deactivates the pump. In this manner, the pump is only activated when necessary to pump water out of the drain pan, thereby prolonging the life of the pump, while preventing water from overflowing the sides of the drain pan.

Conventional float sensors require correct adjustment and/or orientation for proper operation. If the float sensor is not correctly oriented, the pump may not be activated before the water overflows the sides of the drain pan. This generally leads to damage to the area around the drain pan which in a typical home could lead to floor, wall or ceiling damage. In addition, typical false signaling causes conventional water sensor switches to activate the pump when insufficient water is present, thereby damaging the pump.

Thus, what is needed is a water sensor for a drain pan water system which does not require undue effort for accurate orientation. In addition, what is needed is a water sensor switch with reduced sensitivity to false signaling. Furthermore, other desirable features and characteristics will become apparent from the subsequent detailed description and the appended claims, taken in conjunction with the accompanying drawings and this background of the disclosure.

SUMMARY OF THE INVENTION

According to the Detailed Description, a water sensor switch is provided for generating a predetermined output in response to a water sensor input. The water sensor switch includes a first and a second input and an output. The first input couples a source line of the water sensor switch to a first power potential. The second input couples a neutral line of the water sensor switch to a second power potential, the second power potential being a neutral potential. The output couples a load line of the water sensor switch to a drain pan system pump. The water sensor switch also includes a water sensor input, a control section and a switching device. The water sensor input receives a drain pan water level detection signal from a water sensor. The control section is coupled to the water sensor input and receives the drain pan water level detection signal therefrom. The control section is also connected to the first and second inputs and generates a switching signal in response to the drain pan water level detection signal. In addition, the switching device is coupled to the control section and connects the first input to the output in response to the switching signal, thereby providing the first power potential as a predetermined output to the pump.

Further, a water sensor system is provided for generating a predetermined output in response to detection of a predetermined water level. The water sensor system includes a water sensor, first and second inputs, an output, a control section and a switching device. The water sensor generates a drain pan water level detection signal in response to detection of water in a drain pan having a water level greater than or equal to the predetermined water level. The first input couples a source line to a first power potential, and the second input couples a neutral line to a second power potential, the second power potential being a neutral potential. The output couples a load line to a drain pan system pump. The control section is coupled to the water sensor and receives the drain pan water level detection signal therefrom and is connected to the first and second inputs, the control section generating a switching signal in response to the drain pan water level detection signal. In addition, the switching device is coupled to the control section for connecting the first input to the output in response to the switching signal to generate the predetermined output (i.e., the first potential) for providing to the drain pan system pump.

In addition, a drain pan system is provided for activating a pump when detecting a predetermined water level in a drain pan. The drain pan system includes the drain pan, the pump, a water sensor, first and second inputs, a control section and a switching device. The water sensor is coupled to the drain pan for detecting a level of water in the drain pan, the water sensor generating a drain pan water level detection signal in response to detection of the level of the water in the drain pan equal to or greater than a predetermined water level. The pump is coupled to the drain pan and, when activated, pumps the water from the drain pan. The first input couples a source line to a first power potential. The second input couples a neutral line to a second power potential, the second power potential being a neutral potential. The control section is coupled to the water sensor for receiving the drain pan water level detection signal therefrom. The control section is also connected to the first and second inputs and generates a switching signal in response to the drain pan water level detection signal. In addition, the switching device is coupled to the control section for connecting the first input to the pump in response to the switching signal, thereby activating the pump to pump the water from the drain pan.

BRIEF DESCRIPTION OF THE DRAWINGS

The accompanying figures, where like reference numerals refer to identical or functionally similar elements throughout the separate views and which together with the detailed description below are incorporated in and form part of the specification, serve to illustrate various embodiments and to explain various principles and advantages in accordance with the present invention.

Figure 1:
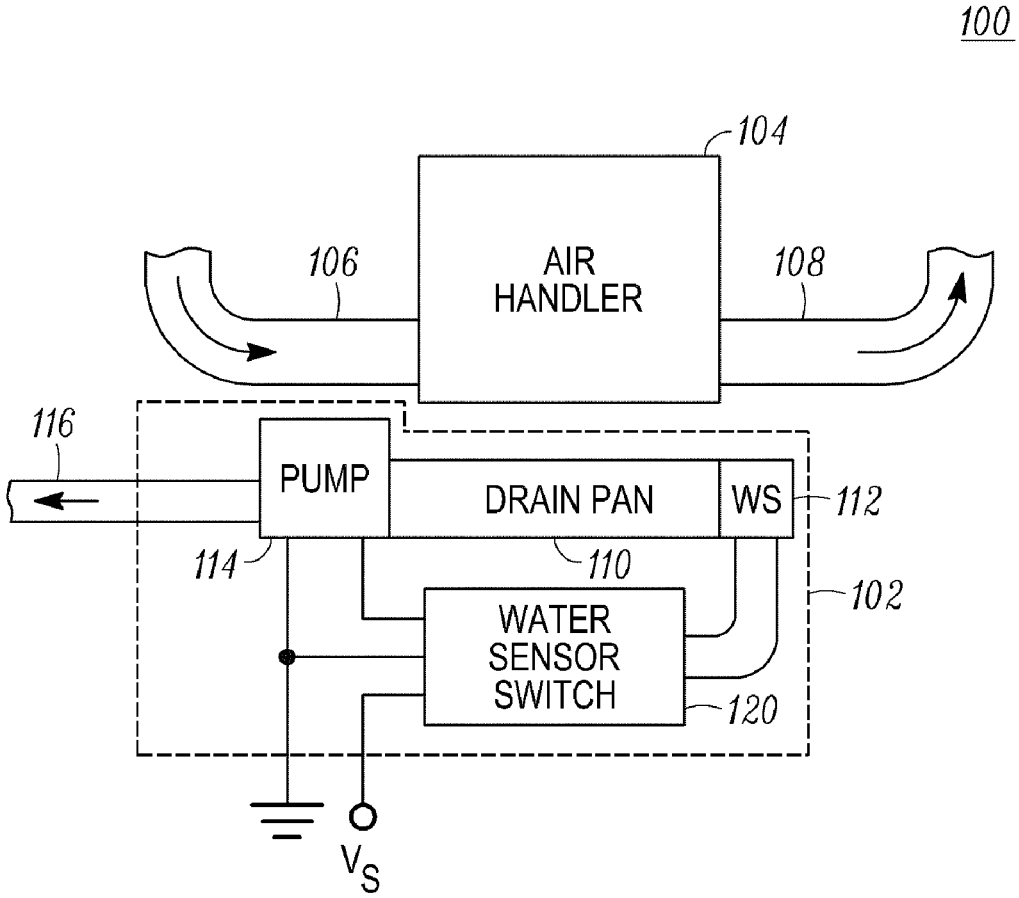
FIG. 1 is a block diagram of a portion of an air handling system, including a drain pan system in accordance with an embodiment of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of apparatus components related to drain pan systems and water sensor switches therefor. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

The following detailed description of the invention is merely exemplary in nature and is not intended to limit the invention or the application and uses of the invention. Furthermore, there is no intention to be bound by any theory presented in the preceding background of the invention or the following detailed description of the invention.

Referring to FIG. 1, a block diagram 100 of a portion of an air handling system, including a drain pan system 102 in accordance with an embodiment of the present invention is depicted. An air handler 104, such as a forced air furnace, ventilator or cooler, receives air from an intake 106 and pushes the air out through a duct 108 altering the temperature of the air as it passes through the air handler 104. Such activity produces condensation, particularly when the air is cooled by an air conditioning system within the air handler 104.

The condensation forms as water on the outside of apparati of the air handler and, by gravity, falls into a drain pan 110. The drain pan 110 is formed so as to be accommodated under all condensatable surfaces of the air handler 104, the drain pan 110 having a shape to facilitate capturing a volume of the condensated water. A water sensor 112 is coupled to the drain pan 110 to measure a level of the water in the drain pan 110. A water removal device, such as a pump 114, is also coupled to the drain pan to remove the water out of the drain pan when activated by, for example, the pump 114 pumping the water out through a pipe 116.

A water sensor switch 120 is coupled to the water sensor 112 for receiving a drain pan water level detection signal therefrom. The drain pan water level detection signal indicates a level of the water within the drain pan 110 as described hereinbelow. The water sensor switch 120 is also coupled to the pump 114 for activating the pump to pump the water from the drain pan 110 in response to the drain pan water level detection signal from the water sensor 112.

Figure 2:
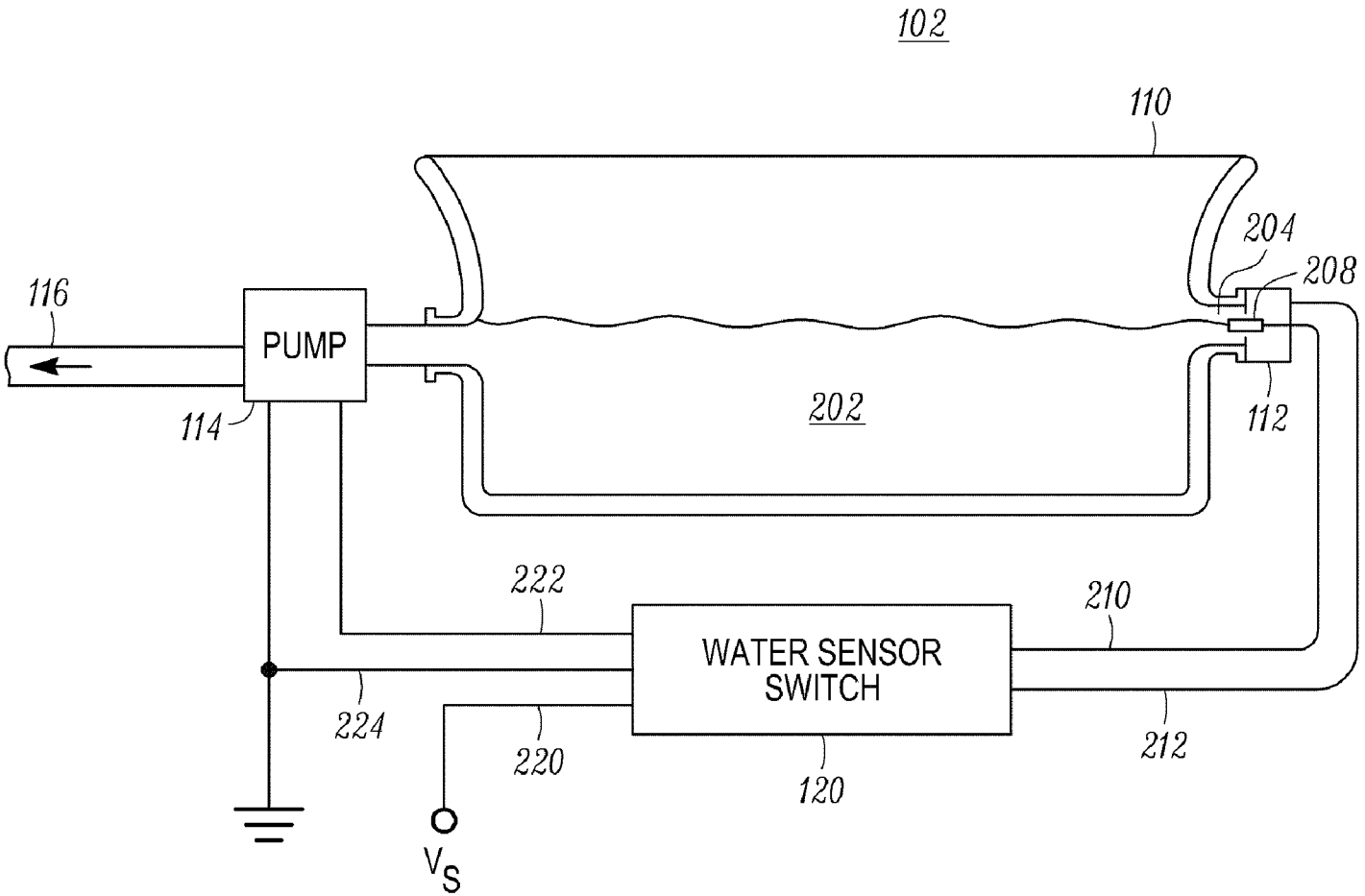
FIG. 2 is a cross-sectional view of the drain pan system in accordance with the embodiment of the present invention.

Referring to FIG. 2, a cross-sectional view of the drain pan system 102 in accordance with the embodiment of the present invention shows water 202 within the drain pan 110. The water sensor 112 is coupled to the drain pan 110 by, for example, screwing the water sensor onto a threaded male receiving port 204 of the drain pan. One or more electrical contacts 208 of the water sensor 112 are exposed to the drain pan 110. The water sensor 112 generates the drain pan water level detection signal in response to the water 202 in the drain pan 110 contacting the one or more electrical contacts in a predetermined manner to cause a current to flow in the wires 210 and 212. The electrical contact(s) 208 of the water sensor 112 are arranged in such a manner that the water sensor 112 generates the drain pan water level detection signal in response to detection of the water 202 in the drain pan 110 having a water level greater than or equal to a predetermined water level. In this manner, the water sensor 112 generates the drain pan water level detection signal before the water level in the drain pan 110 becomes so high as to overflow the drain pan 110.

The wires 210 and 212 are connected to the water sensor switch 120 to provide the drain pan water level detection signal thereto. The water sensor switch 120 receives a source potential on a source line 220 and provides a load potential 222 to the pump 114 for activation thereof when receiving the drain pan water level detection signal from the water sensor 112. To reduce the water sensor switch 120 from falsely signaling the pump 116 to activate before the water level is at or above the predetermined water level, a neutral line 224 couples the circuitry of the water sensor switch 120 to a ground potential, such as the ground wire of the pump 114. In this manner, the water sensor switch 120 advantageously provides reduced sensitivity to false signaling.

Figure 3A:
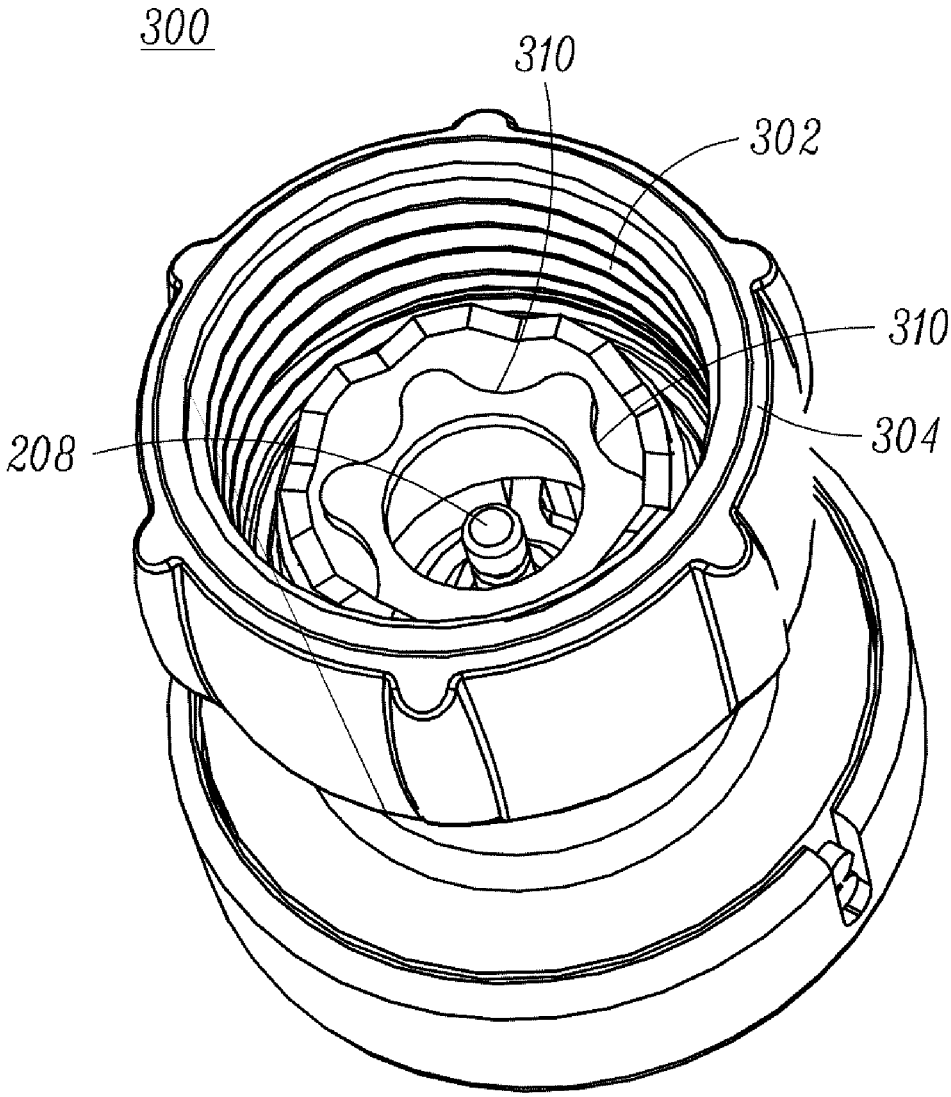
FIG. 3A is a bottom perspective view of a water sensor of the drain pan system of FIG. 2 in accordance with the embodiment of the present invention.

Referring to FIG. 3A, a bottom perspective view 300 of the water sensor 112 in accordance with the embodiment of the present invention depicts a single electrical contact 208 in the center thereof which is connected to the wire 210 (FIG. 2). The threads 302 on the casing 304 allow for easy and firm attachment of the water sensor 112 to the drain pan 110. The second "electrical contact" is a portion of the casing 304 which is connected to the wire 212 (FIG. 2). Due to the centrally located single electrical contact 208, the water sensor 112 does not require undue effort for accurate orientation. In addition, the central position of the electrical contact 208 beneficially prevents a delay in providing the drain pan water level detection signal as the water rises in the drain pan 110 because the drain pan water level detection signal will be consistently generated at a predetermined drain pan water level. The scalloped portions 310 are provided in the ring of the water sensor 112 to allow water to freely flow into and out of the portion of the water sensor 112 where the electrical contact 208 is located.

Figure 3B:
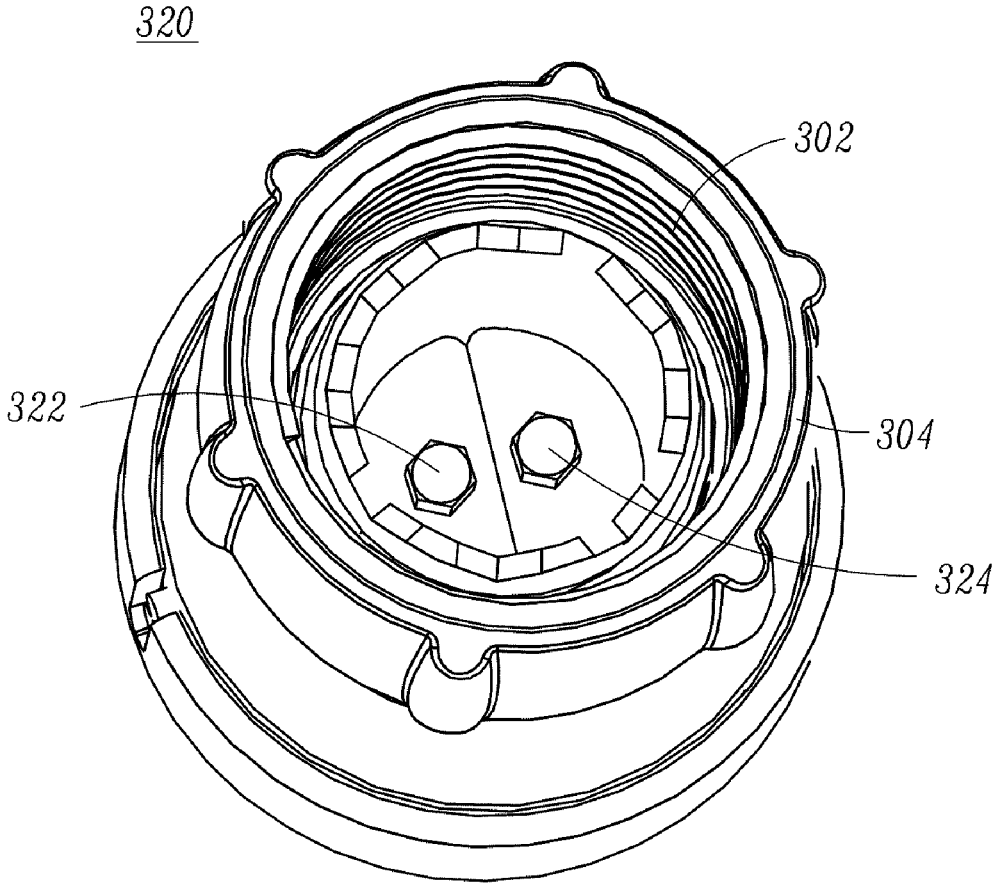
FIG. 3B is a bottom perspective view of a water sensor of the drain pan system of FIG. 2 in accordance with an alternate embodiment of the present invention.

Referring to FIG. 3B, a bottom perspective view 320 of an alternative embodiment of the water sensor 112 depicts dual electrical contacts 322, 324 which are connected to the wires 210, 212 (FIG. 2), respectively. The threads 302 on the casing 304 allow for easy and firm attachment of the water sensor 112 to the drain pan 110. Similar to the water sensor 112 of view 300 (FIG. 3A), the arrangement of the electrical contacts 322, 324 beneficially prevents a delay in providing the drain pan water level detection signal as the water rises in the drain pan 110 because the drain pan water level detection signal will be consistently generated at a predetermined drain pan water level. In this alternative embodiment, however, the predetermined drain pan water level will be determined in response to the orientation of the water sensor 112. If the water sensor 112 is oriented such that the electrical contacts 322, 324 are in a horizontally planar relationship, the predetermined drain pan water level is a lowest predetermined drain pan water level. When the water sensor 112 is oriented such that the electrical contacts 322, 324 are in a vertically planar relationship, the predetermined drain pan water level is a highest predetermined drain pan water level. Thus, in accordance with this alternate embodiment, rotating the water sensor 112 between the horizontal electrical contact orientation and the vertical electrical contact orientation adjusts a trigger point level of the water sensor 112 between the lowest predetermined drain pan water level and the highest predetermined drain pan water level.

Figure 4:
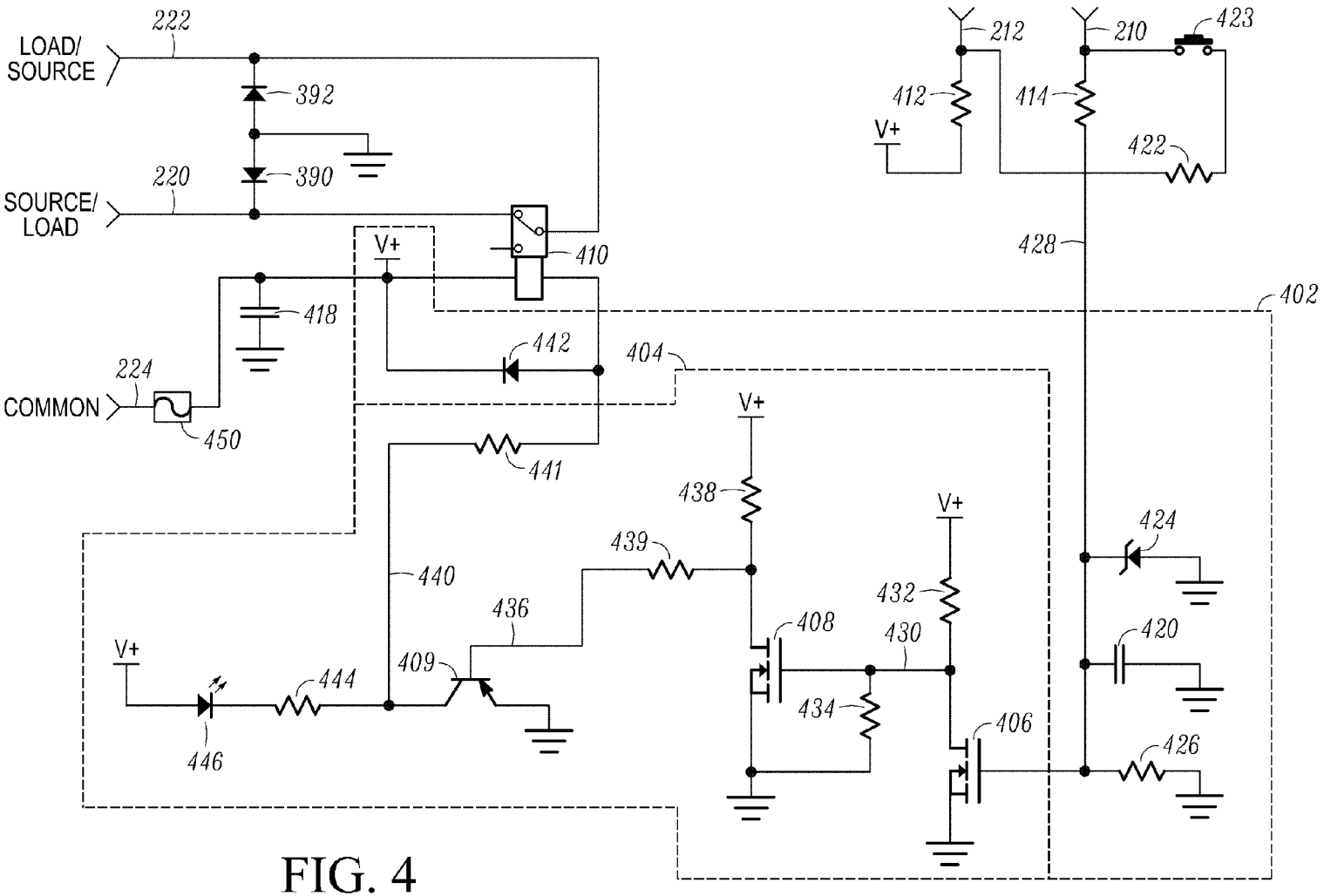
FIG. 4 is a schematic diagram of a water sensor switch circuit of the drain pan system of FIG. 2 in accordance with the embodiment of the present invention.

Referring to FIG. 4, a schematic diagram 400 of a circuit of the water sensor switch 120 in accordance with one embodiment of the present invention includes a first terminal for coupling the source line 220 of the water sensor switch to a first power potential. A second terminal is provided for coupling the common line 224 to a second power potential. And a third terminal is provided as an output of the water sensor switch 120 to couple the load line 222 to the pump 114 (FIG. 2). In accordance with this embodiment, the difference between the second power potential and the first power potential is an operational voltage such as, for example, twenty-four volts. By providing a negative voltage Vs as the first potential (see FIG. 1), and connecting diodes 390 and 392 between the first and third terminals for protection thereof, the first and third terminals are interchangeable, advantageously allowing coupling of source and load lines 220, 222 of the water sensor switch 120 to either of the first power potential input connection or an output connection to the pump 114.

The water sensor switch 120 also includes a water sensor input for receiving the drain pan water level detection signal from the water sensor 112 on lines 210 and 212. A control section 402 is coupled to the water sensor input and receives the drain pan water level detection signal therefrom. The control section 402 is also connected to the source and neutral inputs 220, 224 and generates a switching signal in response to the drain pan water level detection signal, advantageously using the neutral line 224 for better control of the switching signal generation.

The control section 402 includes an amplification section 404 for amplifying and/or conditioning the drain pan water level detection signal to generate the switching signal at a voltage potential higher than a voltage potential of the drain pan water level detection signal. The amplification section 404 includes a first small signal field effect transistor 406, a second small signal field effect transistor 408 and a transistor 409 for amplifying the drain pan water level detection signal.

A relay 410 is a switching device coupled to the control section 402 and activated in response to the amplified switching signal from the amplification section 404 to connect the source and load lines 220, 222, thereby activating the pump.

Resistors 412 and 414 are respectively connected between the lines 212, 210 of the water sensor input for creating a voltage drop in the drain pan water level detection signal from the water sensor 112 so as to protect the control section 402. In accordance with the embodiment, the resistors 412, 414 have a value of one hundred thousand ohms so that the drain pan water level detection signal will be provided as a small level signal to a gate of the first small signal field effect transistor 406. The line 212 from the water sensor 112 is coupled to the common line 224 (V+) and the line 210 from the contact 208 is coupled to the control section 402 for providing the drain pan water level detection signal thereto on line 428. Protection of the first small signal field effect transistor 406 and proper biasing of the signal at the gate thereof is provided by a capacitor 420, a zener diode 424, and a resistor 426 connected between the line 428 and ground in a manner well-known to those skilled in the art.

Additional protection for the control section 402 is provided by a capacitor 418 connected between the common line 224 and ground which removes unwanted voltage fluctuations to maintain the common line 224 at voltage V+ and a fuse 450 provided in line on the common line 224, the fuse 450 providing protection of the water sensor switch 120 from an unduly high voltage on the common line 224.

The line 212 from the water sensor 112 is coupled to the neutral line 224 and the line 210 from the contact 208 is coupled to the control section 402 for providing the drain pan water level detection signal thereto on line 428. A self-test function is provided by a resistor 422 in series with a switch 423 which, when activated, connects the line 212 to the line 210 as if water was present to provide the drain pan water level detection signal on line 428. In normal operation, the drain pan water level detection signal is provided on line 428 to the gate of the first small signal field effect transistor 406 properly biased by the resistor 426 in respect to ground, the source of the first small signal field effect transistor 406 being connected to ground.

The amplification section 404 amplifies the drain pan water level detection signal and creates a sufficient current flowing through a coil of the relay 410 for proper operation by the first small signal field effect transistor 406 generating a signal on a line 430 connected to a drain thereof. The signal is generated by the switching operation of the first small signal field effect transistor 406 in response to the drain pan water level detection signal and has a voltage level offset from the voltage V+ on the common line 224 by a voltage drop across a resistor 432 and offset from ground by a voltage drop across a resistor 434. The signal is provided on line 430 to a gate of the second small signal field effect transistor 408. The source of the second small signal field effect transistor 408 is connected to ground and the drain of the second small signal field effect transistor 408 is connected to a base of the transistor 409 on a line 436, the voltage on the line 436 offset from the voltage V+ on the common line 224 by a voltage drop across a resistor 438 and further reduced by a voltage drop across a resistor 439. An emitter of the transistor 409 is connected to ground and a collector of the transistor 409 is connected to a line 440. The line 440 is connected through a resistor 441 to provide operational voltage to one side of the coil of the relay 410. In addition, the line 440 is connected to an anode of a coil protection diode 442. The other side of the coil of the relay 410 is connected to the common line 224 and V+, as well as to a cathode of the protection diode 442. The voltage on line 440 is biased by a light-emitting diode (LED) 446 and a resistor 444 connected in series between the V+ voltage of the common line and the line 440. The LED 446 also provides a visual status of the operational condition of the water sensor switch 120 by lighting up when current is flowing therethrough.

In operation, when the water 202 in the drain pan 110 reaches a sufficient level to touch the contact 208, current flows through the water 202 from the line 210 to the line 212. Thus, the line 210 is coupled to the common line 224 voltage V+ via the line 212. The voltage on line 428 therefore goes high (V+), causing current to flow through the first small signal field effect transistor 406. The signal on line 430 then goes low as it is connected to the ground through the first small signal field effect transistor 406, disconnecting the drain of the second small signal field effect transistor 408 from ground and causing current to flow in line 436 to the base of the transistor 409. In response to the signal on line 436, the transistor 409 connects line 440 to ground, pulling the voltage at the anode of the diode 442 lower than the voltage at the cathode of the diode 442. In this manner, the diode 442 blocks current flow therethrough, causing current to flow through the coil of the relay 410 from V+ through the transistor 409 to ground to connect the source line 220 to the load line 222. In this manner, the control section 402 activates the relay 410 switching device to connect the source line 220 to the load line 222 to activate the pump 114 in response to the water 202 rising to a level touching the contact 208.

Figure 5:
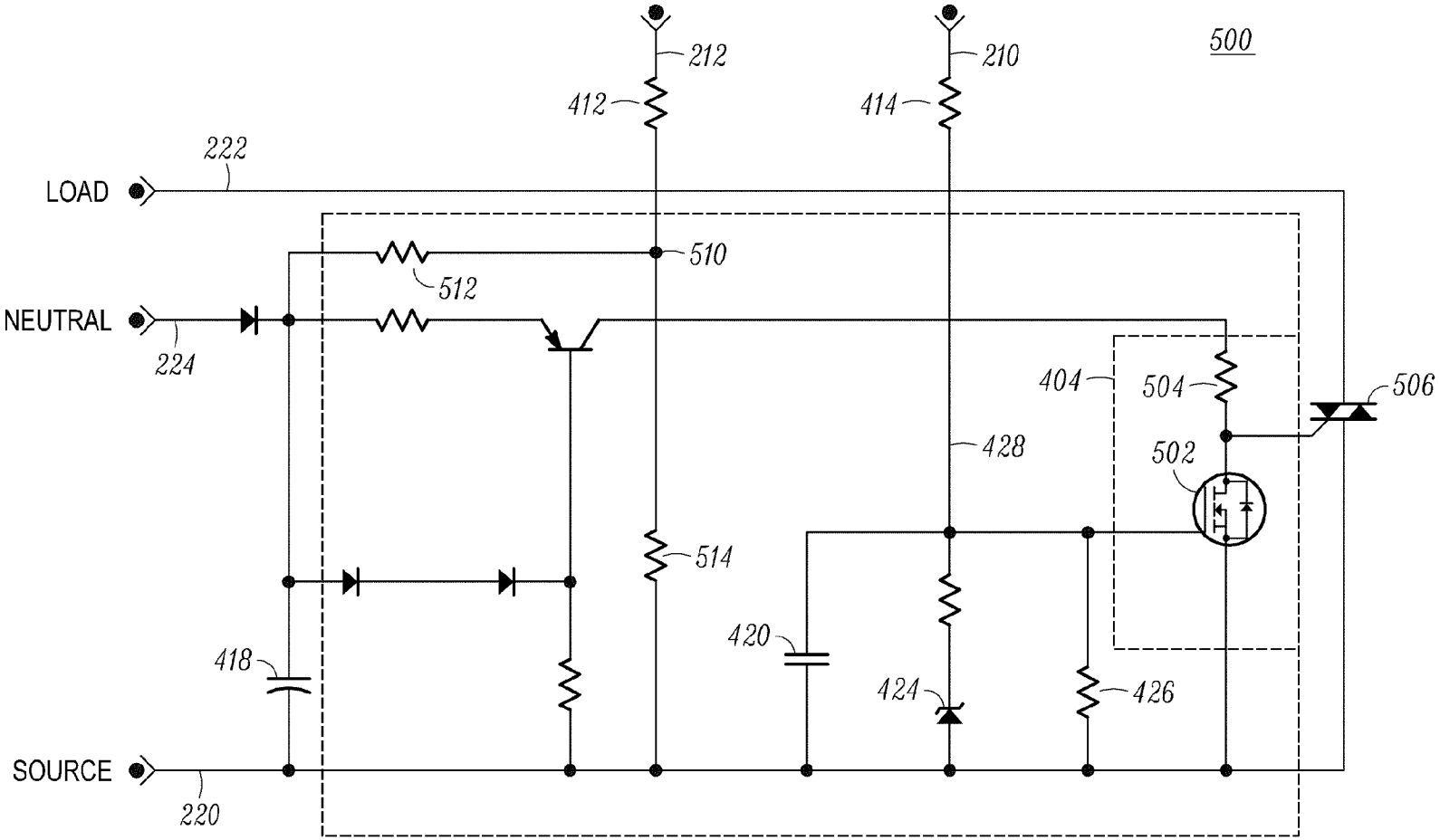
FIG. 5 is a schematic diagram of a water sensor switch circuit of the drain pan system of FIG. 2 in accordance with an alternate embodiment of the present invention.

While an advantageous implementation for the embodiment of the water sensor switch 120 has been depicted in FIG. 4, those skilled in the art will realize that various alterations, modifications and adjustments can be made to the circuitry described without departing from the scope of the present invention. For example, referring to FIG. 5, a schematic diagram 500 depicts an alternative embodiment of the circuit of the water sensor switch 120 particularly applicable for low voltage solid state operation. The signal from the contact 208 provided on line 428 is connected to a single small signal field effect transistor 502 of the amplification section 404. Operation of the small signal field effect transistor 502 provides a signal at the drain of the small signal field effect transistor 502 biased by a resistor 504 to control the switching operation of a triac 506 switching device. The triac 506 is a bidirectional electronic switch which conducts when triggered by an appropriate voltage from the drain of the small signal field effect transistor 502.

A node 510 coupled to the line 212 is maintained at a voltage between the voltage of a neutral or common line 224 and the source line 220 by resistors 512 and 514. The low voltage solid state operation is protected in a manner well-known to those skilled in the art by additional resistors, diodes and a transistor coupled to and between the neutral line 224 and the source line 220.

Thus it can be seen that a drain pan system 102, including a water sensor switch 120, has been disclosed which advantageously provides a water sensor 112 which does not require undue effort for accurate orientation and a water sensor switch 120 with reduced sensitivity to false signaling. While at least one exemplary embodiment has been presented in the foregoing detailed description of the invention, it should be appreciated that a vast number of variations exist.

For example, since the switch 410 (FIG. 4) connects the source and load lines 220, 222, the poles of the switch 410 could be wired to the lines 220, 222 such that the source is normally connected to the load. A signal from the control section 402 in response to the drain pan water level detection signal generated in response to the water sensor 112 causes the switch 410 to open, thereby disconnecting the source and load. The drain pan system 102 could be constructed such that when power is disconnected from the load, the drain pan 110 is emptied (e.g., wherein the water removal device is a drain cover in the bottom of the drain pan 110 which is closed when power is provided thereto and opens when power is not provided thereto). In this manner, if power is interrupted, the drain pan will empty by gravity. Thus, provision of a control circuit such as that described in the schematic diagram of FIG. 4 can advantageously provide a drain pan system without any of the disadvantages associated with pump malfunction or power failure.

In addition, in this document, relational terms such as first and second, top and bottom, and the like are used solely to distinguish one entity or action from another entity or action without necessarily requiring or implying any actual such relationship or order between such entities or actions. The terms "includes", "including", or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "includes . . . a" does not, without more constraints, preclude the existence of additional identical elements in the process, method, article, or apparatus that comprises the element.

It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

What is claimed is:

1. A condensate sensor system for use with a condensate drain pan to generate a control signal when the condensate within the condensate drain pan reaches a predetermined level comprising;

a condensate sensor switch including a first terminal for coupling a source line of said condensate sensor switch to a first power potential, a second terminal for coupling a common line of said condensate sensor switch to a second power potential and a third terminal for coupling a load line of said condensate sensor switch to a load;

a condensate sensor input for receiving a drain pan condensate level detection signal from a condensate sensor when the condensate within the condensate drain pan reaches the predetermined level;

a control section coupled to said condensate sensor input for receiving said drain pan condensate level detection signal therefrom;

said control section being connected to said first and second terminals for generating said control signal in response to said drain pan condensate level detection signal; and a switching device coupled to said control section for connecting a first terminal to said third terminal in response to said control signal, wherein said condensate sensor comprises a pair of electrical contacts disposed in spaced relationship relative to each other to form an electrical circuit therebetween when each said electrical contact condensate in the condensate drain pan, wherein the rotational position of that condensate sensor relative to the condensate drain pan determines the predetermined level of condensate at which electrical circuit is complete such that when said electrical contacts are rotated in a horizontally planar relationship to each other, the predetermined drain pan condensate level is a lowest predetermined drain pan condensate level, and when said condensate sensor is oriented such that the electrical contacts are rotated in a vertically planar relationship to each other, the predetermined drain pan condensate level is a highest predetermined drain pan condensate level whereby rotating said condensate sensor between said horizontal electric contact orientation and said vertical electrical contact orientation adjusts a trigger point level of the condensate sensor between the lowest predetermined drain pan condensate level and the highest predetermined drain pan condensate level.

2. The condensate sensor switch in accordance with claim 1 wherein the switching device is a relay device.

3. The condensate sensor switch in accordance with claim 1 wherein the switching device is a triac device.

4. The condensate sensor switch in accordance with claim 1 wherein the control section includes an amplification section for amplifying the drain pan condensate level detection signal to generate the switching signal at a voltage potential higher than a voltage potential of the drain pan condensate level detection signal.

5. The condensate sensor switch in accordance with claim 4 wherein the amplification section includes at least one small signal field effect transistor.

6. A condensate sensor system for use with a condensate drain pan to generate a control signal when the condensate within the condensate drain pan reaches a predetermined level comprising;

a condensate sensor switch including a first terminal for coupling a source line of said condensate sensor switch to a first power potential, a second terminal for coupling a common line of said condensate sensor switch to a second power potential and a third terminal for coupling a load line of said condensate sensor switch to a load;

a condensate sensor input for receiving a drain pan condensate level detection signal from a condensate sensor when condensate within the condensate drain pan reaches the predetermined level;

a control section coupled to said condensate sensor input for receiving said drain pan condensate level detection signal therefrom, said control section being connected to said first and second terminals for generating said control signal in response to said drain pan condensate level detection signal; and a switching device coupled to said control section for connecting said first terminal to said third terminal in response to said control signal, wherein the condensate drain pan includes a dam and said condensate sensor extends inward past the dam into the condensate drain pan, wherein the rotational position of that condensate sensor relative to the condensate drain pan determines the predetermined level of condensate at which electrical circuit is complete such that when said electrical contacts are rotated in a horizontally planar relationship to each other, the predetermined drain pan condensate level is a lowest predetermined drain pan condensate level, and when said condensate sensor is oriented such that the electrical contacts are rotated in a vertically planar relationship to each other, the predetermined drain pan condensate level is a highest predetermined drain pan condensate level whereby rotating said condensate sensor between said horizontal electric contact orientation and said vertical electrical contact orientation adjusts a trigger point level of the condensate sensor between the lowest predetermined drain pan condensate level and the highest predetermined drain pan condensate level.

7. The condensate sensor switch in accordance with claim 6 wherein the switching device is a relay device.

8. The condensate sensor switch in accordance with claim 6 wherein the switching device is a triac device.

9. The condensate sensor switch in accordance with claim 6 wherein the control section includes an amplification section for amplifying the drain pan condensate level detection signal to generate the switching signal at a voltage potential higher than a voltage potential of the drain pan condensate level detection signal.

10. The condensate sensor switch in accordance with claim 9 wherein the amplification section includes at least one small signal field effect transistor.

* * * * *